US007600972B2

(12) United States Patent
Benjamin et al.

(10) Patent No.: US 7,600,972 B2
(45) Date of Patent: Oct. 13, 2009

(54) METHODS AND APPARATUS FOR COOLING GAS TURBINE ENGINE ROTOR ASSEMBLIES

(75) Inventors: Edward Durell Benjamin, Simpsonville, SC (US); Jeffrey John Butkiewicz, Simpsonville, SC (US); Mark Steven Honkomp, Taylors, SC (US); Stephen Paul Wassynger, Simpsonville, SC (US); Emilio Fernandez, Taylors, SC (US); Carlos Alberto Collado, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/699,060

(22) Filed: Oct. 31, 2003

(65) Prior Publication Data

US 2005/0095128 A1 May 5, 2005

(51) Int. Cl.
*F01D 5/18* (2006.01)

(52) U.S. Cl. ..... 416/97 R; 416/95; 416/96 R; 416/193 A; 416/248; 29/889.21

(58) Field of Classification Search ..... 416/95, 416/96 R, 96 A, 97 R, 191, 193 A, 248; 415/115, 415/173.7; 29/889.21, 889.22
See application file for complete search history.

(56) References Cited

U.S. PATENT DOCUMENTS 2,912,223 A * 11/1959 Hull, Jr. ..... 416/500
2,915,279 A * 12/1959 Chamberlin ..... 416/97 R
3,369,792 A 2/1968 Kraimer et al.
4,236,870 A 12/1980 Hucul, Jr. et al.
4,589,824 A 5/1986 Kozlin
4,726,104 A 2/1988 Foster et al.
4,917,574 A * 4/1990 Dodd et al. ..... 416/193 A
5,215,431 A 6/1993 Derrien
5,261,789 A 11/1993 Butts et al.
5,281,097 A * 1/1994 Wilson et al. ..... 416/193 A
5,342,172 A 8/1994 Coudray et al.

(Continued)

FOREIGN PATENT DOCUMENTS

EP 0801208 A2 10/1997

(Continued)

OTHER PUBLICATIONS

CN App. No. 200410088035.1 First Office Action (Apr. 6, 2007).

*Primary Examiner*—Christopher Verdier
(74) *Attorney, Agent, or Firm*—Armstrong Teasdale LLP

(57) ABSTRACT

A method and apparatus for a rotor assembly for gas turbine engine are provided. A first rotor blade including an airfoil, a platform, a shank, an internal cavity, and a dovetail is provided, wherein the airfoil extends radially outward from the platform, which includes a radially outer surface and a radially inner surface, the shank extends radially inward from the platform, and the dovetail extends from the shank, such that the internal cavity is defined by the airfoil, the platform, the shank, and the dovetail. The first rotor blade is coupled to a rotor shaft such that during engine operation, cooling air is channeled from the cavity through an impingement cooling circuit for impingement cooling the first rotor blade platform radially inner surface, and a second rotor blade is coupled to the rotor shaft such that a platform gap is defined between the first and second rotor blade platforms.

28 Claims, 6 Drawing Sheets

U.S. PATENT DOCUMENTS 5,503,527 A 4/1996 Lee et al.
5,503,529 A 4/1996 Anselmi et al.
5,669,759 A 9/1997 Beabout
5,772,397 A 6/1998 Morris et al.
5,772,398 A 6/1998 Noiret et al.
5,800,124 A 9/1998 Zelesky
6,086,329 A * 7/2000 Tomita et al. ..... 416/193 A
6,120,249 A 9/2000 Hultgren et al.
6,164,914 A 12/2000 Correia et al.
6,174,135 B1 1/2001 Lee
6,179,556 B1 1/2001 Bunker
6,196,799 B1 3/2001 Fukue et al.
6,273,683 B1 * 8/2001 Zagar et al. ..... 416/193 A
6,299,412 B1 10/2001 Wood et al.
6,341,939 B1 * 1/2002 Lee ..... 416/97 R
6,382,913 B1 5/2002 Lee et al.
6,416,284 B1 * 7/2002 Demers et al. ..... 416/97 R
6,419,447 B1 * 7/2002 Watanabe et al. ..... 415/115
6,808,368 B1 * 10/2004 Tomberg et al. ..... 416/223 A
6,923,616 B2 * 8/2005 McRae et al. ..... 415/115
7,147,440 B2 * 12/2006 Benjamin et al. ..... 416/193 A
2005/0095129 A1 * 5/2005 Benjamin et al. ..... 416/97 R

FOREIGN PATENT DOCUMENTS

JP 11236805 8/1998
JP 1063605 A 5/2007

* cited by examiner

METHODS AND APPARATUS FOR COOLING GAS TURBINE ENGINE ROTOR ASSEMBLIES

BACKGROUND OF THE INVENTION

This application relates generally to gas turbine engines and, more particularly, to methods and apparatus for cooling gas turbine engine rotor assemblies.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

During operation, because the airfoil portions of the blades are exposed to higher temperatures than the dovetail portions, temperature mismatches may develop at the interface between the airfoil and the platform, and/or between the shank and the platform. Over time, such temperature differences and thermal strain may induce large compressive thermal stresses to the blade platform. Moreover, over time, the increased operating temperature of the platform may cause platform oxidation, platform cracking, and/or platform creep deflection, which may shorten the useful life of the rotor blade.

To facilitate reducing the effects of the high temperatures in the platform region, at least some known rotor blades include a cooling opening formed within the shank. More specifically, within at least some known shanks the cooling opening extends through the shank for providing cooling air into a shank cavity defined radially inward of the platform. However, within known rotor blades, such cooling openings may provide only limited cooling to the rotor blade platforms.

BRIEF SUMMARY OF THE INVENTION

In one aspect, a method for assembling a rotor assembly for gas turbine engine is provided. The method includes providing a first rotor blade that includes an airfoil, a platform, a shank, an internal cavity, and a dovetail, wherein the airfoil extends radially outward from the platform, the platform includes a radially outer surface and a radially inner surface, the shank extends radially inward from the platform, and the dovetail extends from the shank, such that the internal cavity is defined at least partially by the airfoil, the platform, the shank, and the dovetail. The method also includes coupling the first rotor blade to a rotor shaft using the dovetail such that during engine operation, cooling air is channeled from the blade cavity through an blade impingement cooling circuit for impingement cooling the first rotor blade platform radially inner surface, and coupling a second rotor blade to the rotor shaft such that a platform gap is defined between the first and second rotor blade platforms.

In a further aspect, a rotor blade for a gas turbine engine is provided. The rotor blade includes a platform, an airfoil, a shank, a dovetail, and a cooling circuit. The platform includes a radially outer surface and a radially inner surface, and the airfoil extends radially outward from the platform. The shank extends radially inward from the platform, and the dovetail extends from the shank such that an internal cavity is defined at least partially by the airfoil, the platform, the shank, and the dovetail. The cooling circuit extends through a portion of the shank for supplying cooling air from the cavity for impingement cooling the platform radially inner surface.

In another aspect, a gas turbine engine rotor assembly is provided. The rotor assembly includes a rotor shaft and a plurality of circumferentially-spaced rotor blades that are coupled to the rotor shaft. Each of the rotor blades includes an airfoil, a platform, a shank, and a dovetail. Each airfoil extends radially outward from each respective platform, and each platform includes a radially outer surface and a radially inner surface. Each shank extends radially inward from each respective platform, and each dovetail extends from each respective shank for coupling the rotor blade to the rotor shaft such that an internal blade cavity is defined at least partially by the airfoil, the platform, the shank, and the dovetail. At least a first of the rotor blades includes an impingement cooling circuit extending through a portion of the shank for channeling cooling air from the blade cavity for impingement cooling the platform radially inner surface.

DETAILED DESCRIPTION OF THE INVENTION

Figure 1:
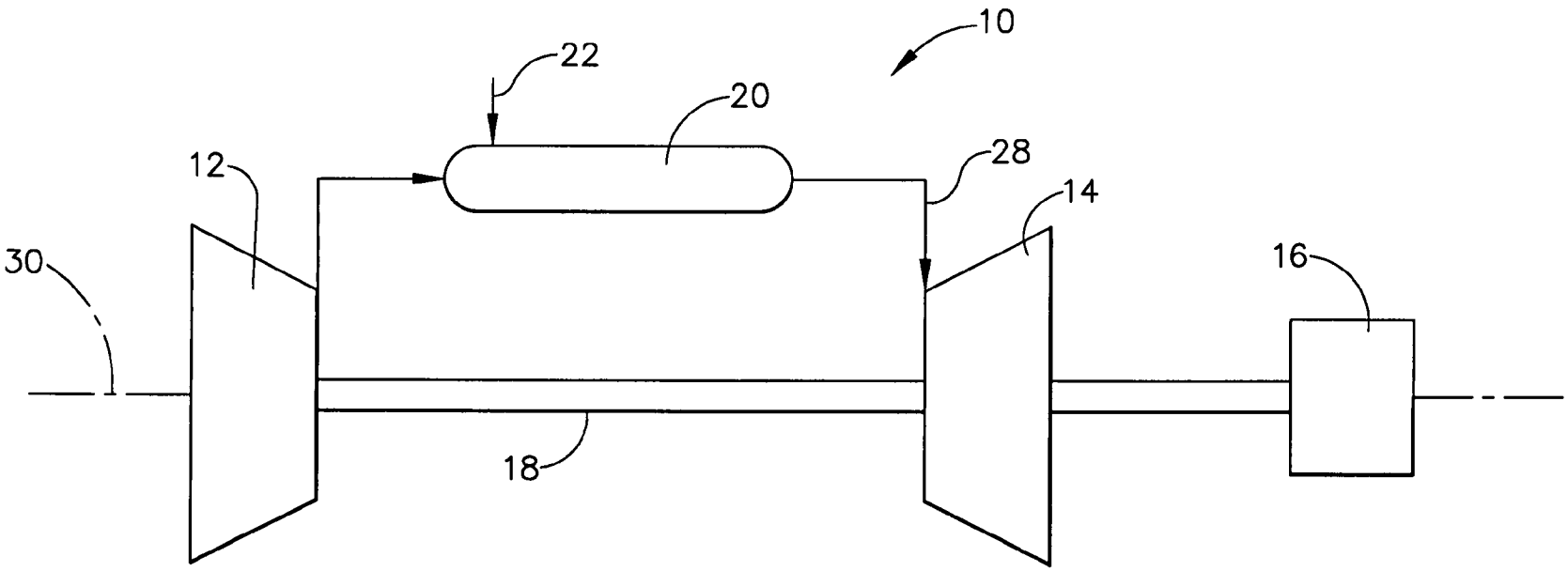
FIG. 1 is schematic illustration of a gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel supplied via a stream 22. In one embodiment, engine 10 is a 9FA+e gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
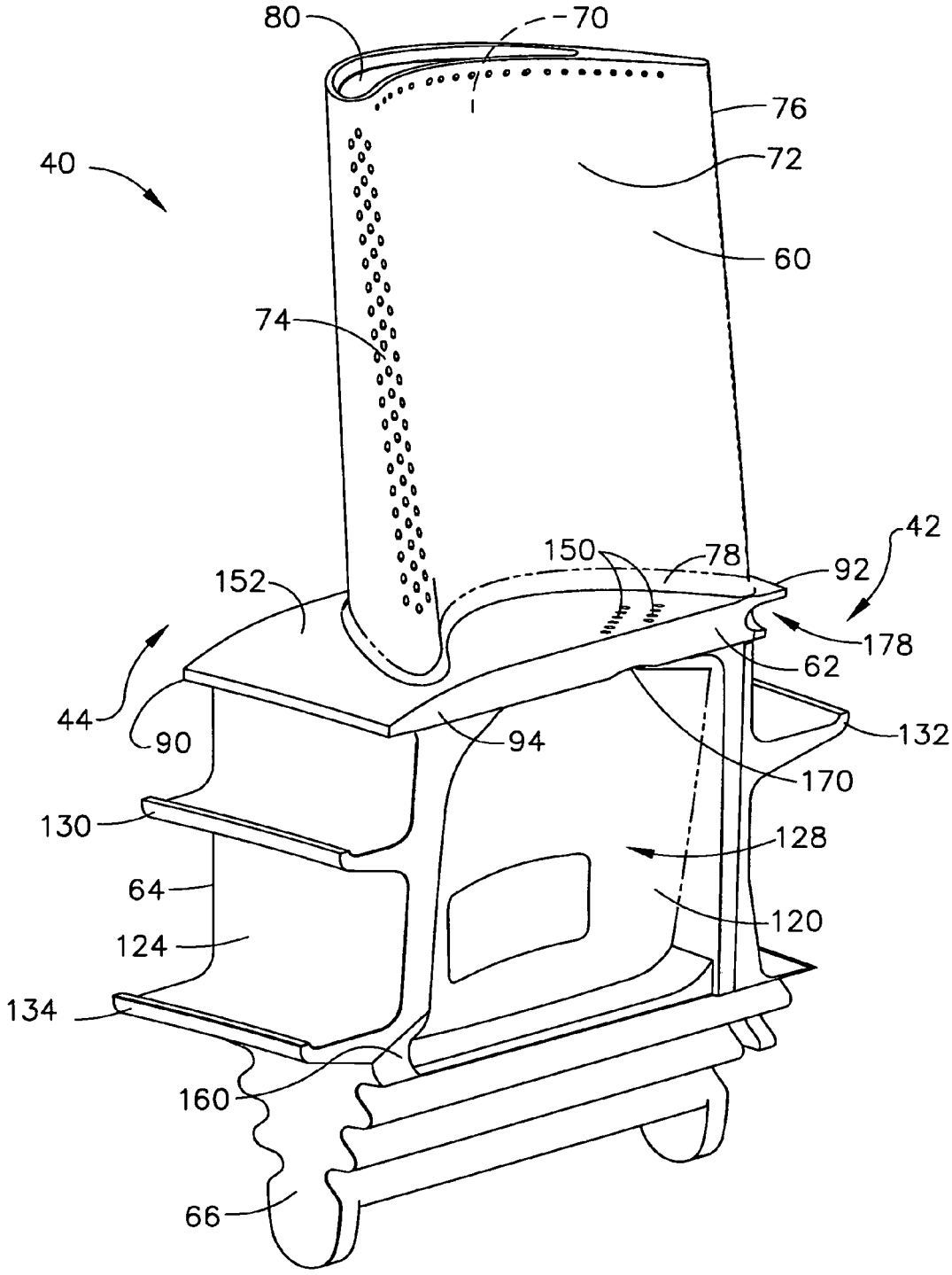
FIG. 2 is an enlarged perspective view of a rotor blade that may be used with the gas turbine engine shown in FIG. 1.
Figure 3:
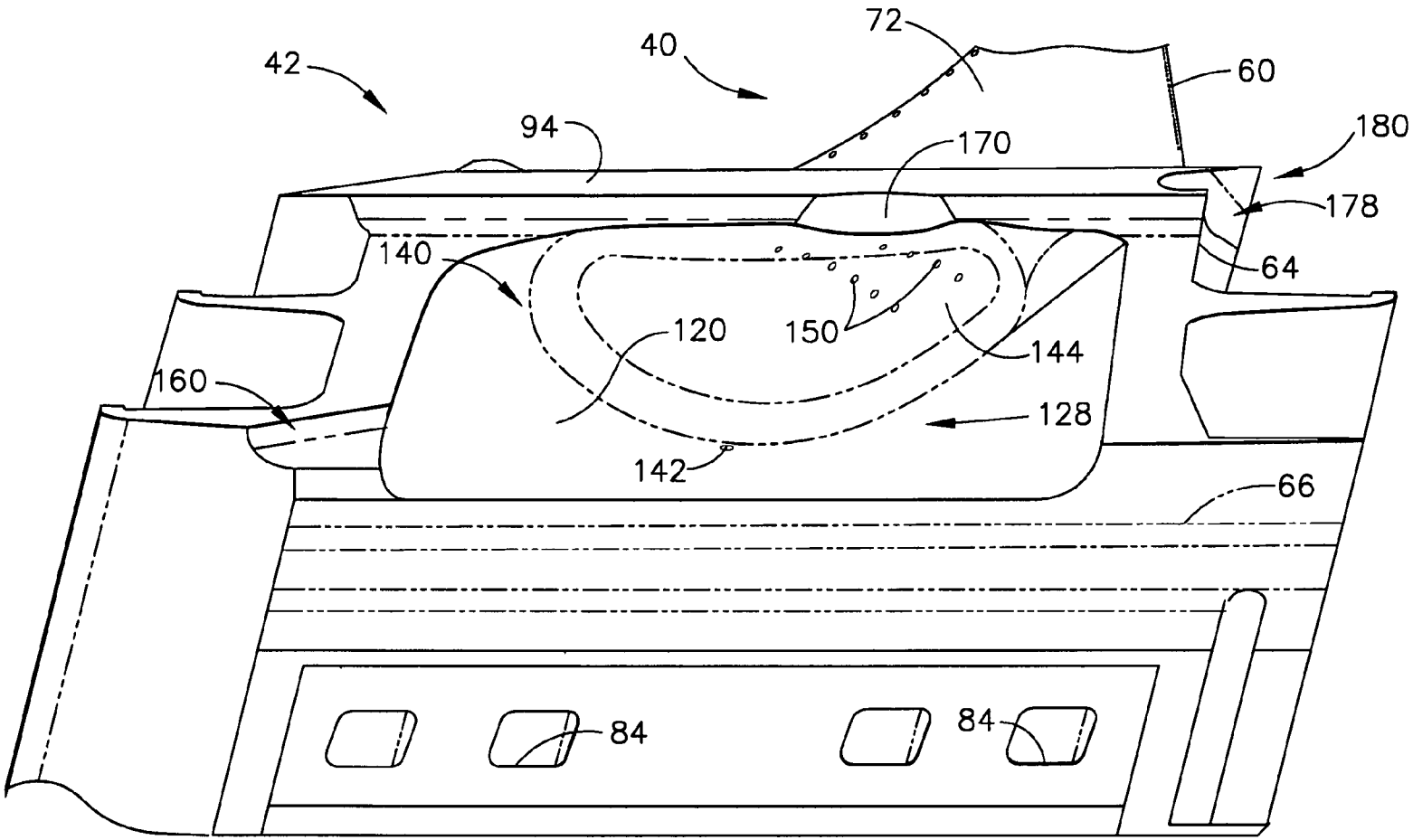
FIG. 3 is an enlarged perspective view of the rotor blade shown in FIG. 2 and viewed from the underside of the rotor blade.
Figure 4:
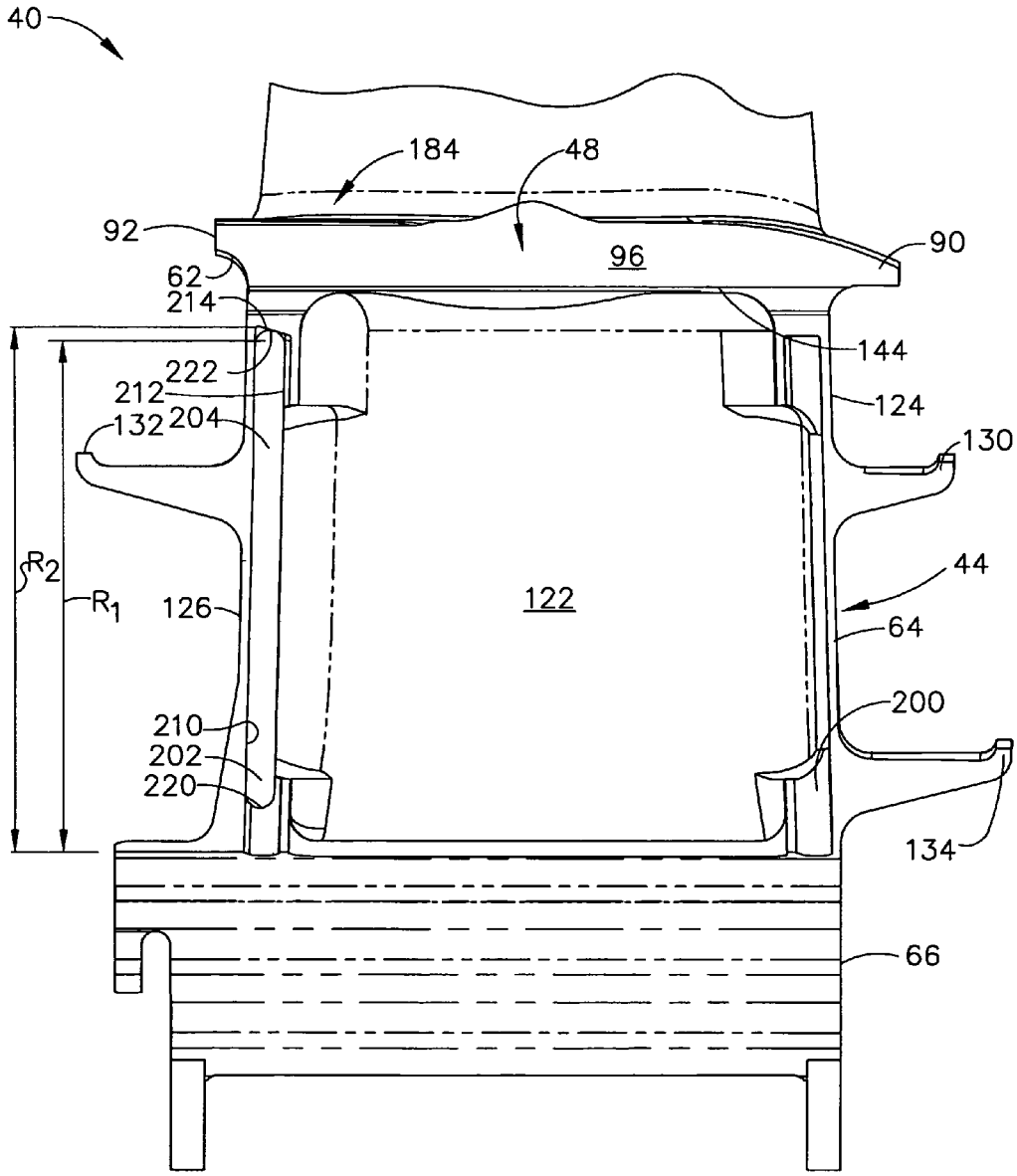
FIG. 4 is a side view of the rotor blade shown in FIG. 2 and viewed from the opposite side shown in FIG. 2.
Figure 5:
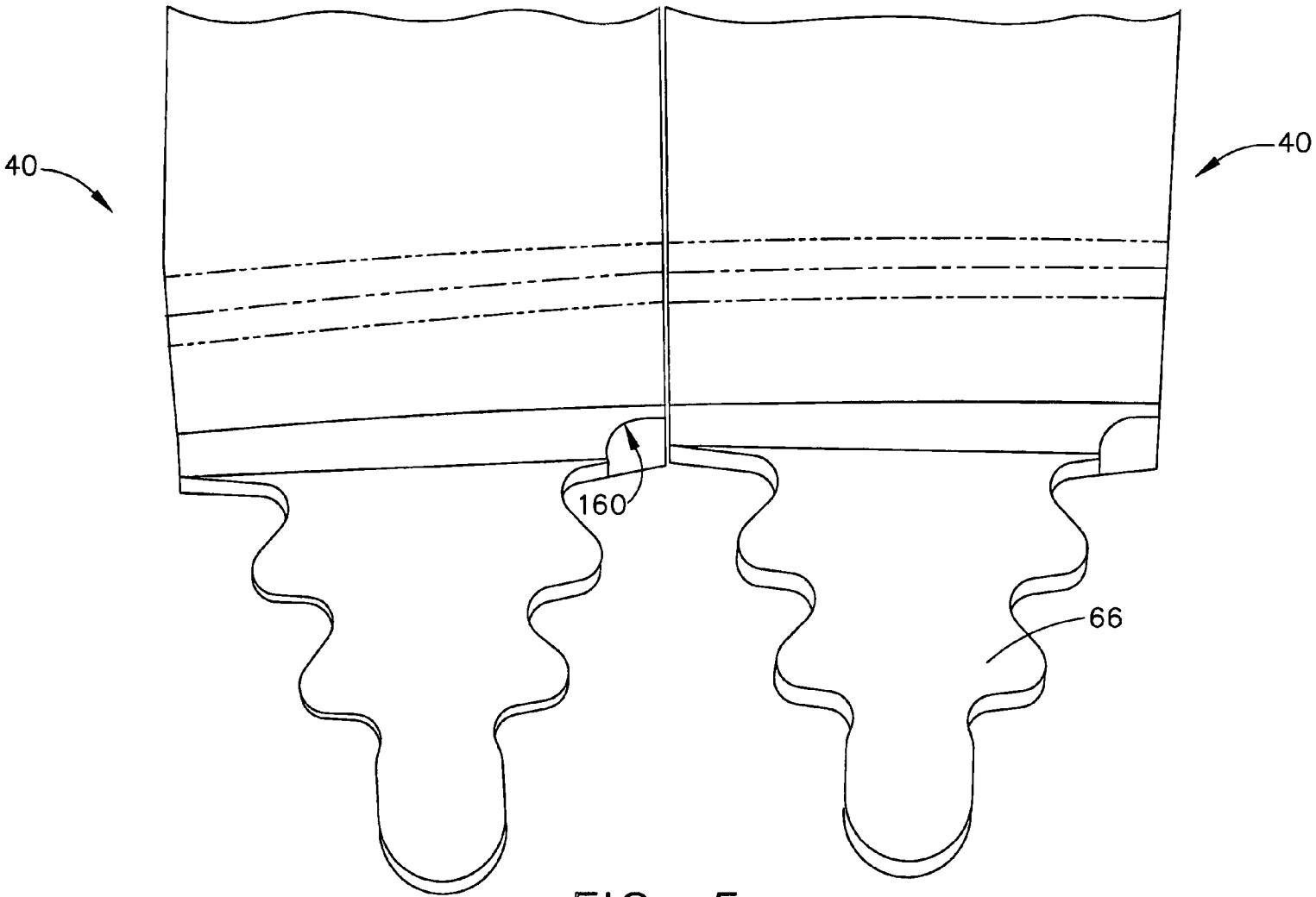
FIG. 5 illustrates a relative orientation of the circumferential spacing between the rotor blade shown in FIG. 2 and other rotor blades when coupled within the gas turbine engine shown in FIG. 1.

FIG. 2 is an enlarged perspective view of a rotor blade 40 that may be used with gas turbine engine 10 (shown in FIG. 1) viewed from a first side 42 of rotor blade 40. FIG. 3 is an enlarged perspective view of rotor blade 40 and viewed from the underside of the rotor blade 10, and FIG. 4 is a side view of rotor blade shown in FIG. 2 and viewed from an opposite second side 44 of rotor blade 40. FIG. 5 illustrates a relative orientation of the circumferential spacing between circumferentially-spaced rotor blades 40 when blades 40 are coupled within a rotor assembly, such as turbine 14 (shown in FIG. 1).

In one embodiment, blade 40 is a newly cast blade 40. In an alternative embodiment, blade 40 is a blade 40 that has been used and is retrofitted to include the features described herein. More specifically, when rotor blades 40 are coupled within the rotor assembly, a gap 48 is defined between the circumferentially-spaced rotor blades 40.

When coupled within the rotor assembly, each rotor blade 40 is coupled to a rotor disk (not shown) that is rotatably coupled to a rotor shaft, such as shaft 18 (shown in FIG. 1). In an alternative embodiment, blades 40 are mounted within a rotor spool (not shown). In the exemplary embodiment, blades 40 are identical and each extends radially outward from the rotor disk and includes an airfoil 60, a platform 62, a shank 64, and a dovetail 66. In the exemplary embodiment, airfoil 60, platform 62, shank 64, and dovetail 66 are collectively known as a bucket.

Each airfoil 60 includes first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber 84 is defined within blades 40. More specifically, internal cooling chamber 84 is bounded within airfoil 60 between sidewalls 70 and 72, and extends through platform 62 and through shank 64 and into dovetail 66.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 40 and 44 to the rotor disk. Platform 62 also includes an upstream side or skirt 90 and a downstream side or skirt 92 which are connected together with a pressure-side edge 94 and an opposite suction-side edge 96. When rotor blades 40 are coupled within the rotor assembly, gap 48 is defined between adjacent rotor blade platforms 62, and accordingly is known as a platform gap.

Shank 64 includes a substantially concave sidewall 120 and a substantially convex sidewall 122 connected together at an upstream sidewall 124 and a downstream sidewall 126 of shank 64. Accordingly, shank sidewall 120 is recessed with respect to upstream and downstream sidewalls 124 and 126, respectively, such that when buckets 40 are coupled within the rotor assembly, a shank cavity 128 is defined between adjacent rotor blade shanks 64.

In the exemplary embodiment, a forward angel wing 130 and an aft angel wing 132 each extend outwardly from respective shank sides 124 and 126 to facilitate sealing forward and aft angel wing buffer cavities (not shown) defined within the rotor assembly. In addition, a forward lower angel wing 134 also extends outwardly from shank side 124 to facilitate sealing between buckets 40 and the rotor disk. More specifically, forward lower angel wing 134 extends outwardly from shank 64 between dovetail 66 and forward angel wing 130.

A cooling circuit 140 is defined through a portion of shank 64 to provide impingement cooling air for cooling platform 62, as described in more detail below. Specifically, cooling circuit 140 includes an impingement cooling opening 142 formed within shank concave sidewall 120 such that bucket internal cooling cavity 84 and shank cavity 128 are coupled together in flow communication. More specifically, opening 142 functions generally as a cooling air jet nozzle and is obliquely oriented with respect to platform 62 such that cooling air channeled through opening 142 is discharged towards a radially inner surface 144 of platform 62 to facilitate impingement cooling of platform 62.

In the exemplary embodiment, platform 62 also includes a plurality of film cooling openings 150 extending through platform 62. In an alternative embodiment, platform 62 does not include openings 150. More specifically, film cooling openings 150 extend between a radially outer surface 152 of platform 62 and platform radially inner surface 144. Openings 150 are obliquely oriented with respect to platform outer surface 152 such that cooling air channeled from shank cavity 128 through openings 150 facilitates film cooling of platform radially outer surface 152. Moreover, as cooling air is channeled through openings 150, platform 62 is convectively cooled along the length of each opening 150.

To facilitate increasing a pressure within shank cavity 128, in the exemplary embodiment, shank sidewall 124 includes a recessed or scalloped portion 160 formed radially inward from forward lower angel wing 134. In an alternative embodiment, forward lower angel wing 134 does not include scalloped portion 160. Accordingly, when adjacent rotor blades 40 are coupled within the rotor assembly, recessed portion 160 enables additional cooling air flow into shank cavity 128 to facilitate increasing an operating pressure within shank cavity 128. As such, recessed portion 160 facilitates maintaining a sufficient back flow margin for platform film cooling openings 150.

In the exemplary embodiment, platform 62 also includes a recessed portion or undercut purge slot 170. In an alternative embodiment, platform 62 does not include slot 170. More specifically, slot 170 is only defined within platform radially inner surface 144 along platform pressure-side edge 94 and extends towards platform radially outer surface 152 between shank upstream and downstream sidewalls 124 and 126. Slot 170 facilitates channeling cooling air from shank cavity 128 through platform gap 48 such that gap 48 is substantially continuously purged with cooling air.

In addition, in the exemplary embodiment, a platform undercut or trailing edge recessed portion 178 is defined within platform 62. In an alternative embodiment, platform 62 does not include trailing edge recessed portion 178. Platform undercut 178 is defined within platform 62 between platform radially inner and outer surfaces 144 and 152, respectively. More specifically, platform undercut 178 is defined within platform downstream skirt 92 at an interface 180 defined between platform pressure-side edge 94 and platform downstream skirt 92. Accordingly, when adjacent rotor blades 40 are coupled within the rotor assembly, undercut 178 facilitates improving trailing edge cooling of platform 62.

In the exemplary embodiment, a portion 184 of platform 62 is also chamfered along platform suction-side edge 96. In an alternative embodiment, platform 62 does not include chamfered portion 184. More specifically, chamfered portion 184 extends across platform radially outer surface 152 adjacent to platform downstream skirt 92. Accordingly, because chamfered portion 184 is recessed in comparison to platform radially outer surface 152, portion 184 defines an aft-facing step for flow across platform gap 48 such that a heat transfer coefficient across a suction side of platform 62 is facilitated to be reduced. Accordingly, because the heat transfer coefficient is reduced, the operating temperature of platform 62 is also facilitated to be reduced, thus increasing the useful life of platform 62.

Shank 64 also includes a leading edge radial seal pin slot 200 and a trailing edge radial seal pin slot 202. Specifically, each seal pin slot 200 and 202 extends generally radially through shank 64 between platform 62 and dovetail 66. More specifically, leading edge radial seal pin slot 200 is defined within shank upstream sidewall 124 adjacent shank convex sidewall 122, and trailing edge radial seal pin slot 202 is defined within shank downstream sidewall 126 adjacent shank convex sidewall 122.

Each shank seal pin slot 200 and 202 is sized to receive a radial seal pin 204 to facilitate sealing between adjacent rotor blade shanks 64 when rotor blades 40 are coupled within the rotor assembly. Although leading edge radial seal pin slot 200 is sized to receive a radial seal pin 204 therein, in the exemplary embodiment, when rotor blades 40 are coupled within the rotor assembly, a seal pin 204 is only positioned within trailing edge seal pin slot 202 and slot 200 remains empty. More specifically, because slot 200 does not include a seal pin 204, during operation, slot 200 cooperates with shank scalloped portion 160 to facilitate pressurizing cavity 128 such that a sufficient back flow margin is maintained within shank cavity 128.

Trailing edge radial seal pin slot 202 is defined by a pair of opposed axially-spaced sidewalls 210 and 212, and extends radially between dovetail 66 and a radially upper wall 214. In the exemplary embodiment, sidewalls 210 and 212 are substantially parallel within shank downstream sidewall 126, and radially upper wall 214 extends obliquely therebetween. Accordingly, a radial height $R_1$ of inner sidewall 212 is shorter than a radial height $R_2$ of outer sidewall 210. As explained in more detail below, oblique upper wall 214 facilitates enhancing the sealing effectiveness of trailing edge seal pin 204. More specifically, during engine operation, sidewall 214 enables pin 204 to slide radially within slot 202 until pin 204 is firmly positioned against sidewall 210. The radial and axial movement of pin 204 within slot 202 facilitates enhancing sealing between adjacent rotor blades 40. Moreover, in the exemplary embodiment, each end 220 and 222 of trailing edge seal pin 204 is rounded to facilitate radial movement of pin 204, and thus also facilitate enhancing sealing between adjacent rotor blade shanks 64.

During engine operation, at least some cooling air supplied to blade internal cooling chamber 84 is discharged outwardly through shank opening 142. More specifically, opening 142 is oriented such that air discharged therethrough is directed towards platform 62 for impingement cooling of platform radially inner surface 144. Generally, during engine operation, bucket pressure side 42 generally operates at higher temperatures than rotor blade suction side 44, and as such, during operation, cooling opening 142 facilitates reducing an operating temperature of platform 62.

Moreover, airflow discharged from opening 142 is also mixed with cooling air entering shank cavity 128 through shank sidewall recessed portion 160. More specifically, the combination of shank sidewall recessed portion 160 and the empty leading edge radial seal pin slot 200 facilitates maintaining a sufficient back flow margin within shank cavity 128 such that at least a portion of the cooling air within shank 128 may be channeled through platform undercut purge slot 170 and through platform gap 48, and such that a portion of the cooling air may be channeled through film cooling openings 150. As the cooling air is forced outward through slot 170 and gap 48, platform 62 is convectively cooled. Moreover, platform trailing edge recessed portion 178 facilitates reducing an operating temperature of platform 62 within platform downstream skirt 92. In addition, platform 62 is both convectively cooled and film cooled by the cooling air channeled through openings 150.

In addition, because platform chamfered portion 184 defines an aft-facing step for flow across platform 62, the heat transfer coefficient across a suction side of platform 62 is also facilitated to be reduced. The combination of opening 142, openings 150, recessed portion 160 and slot 200 facilitate reducing the operating temperature of platform 62 such that thermal strains induced to platform 62 are also reduced.

Figure 6:
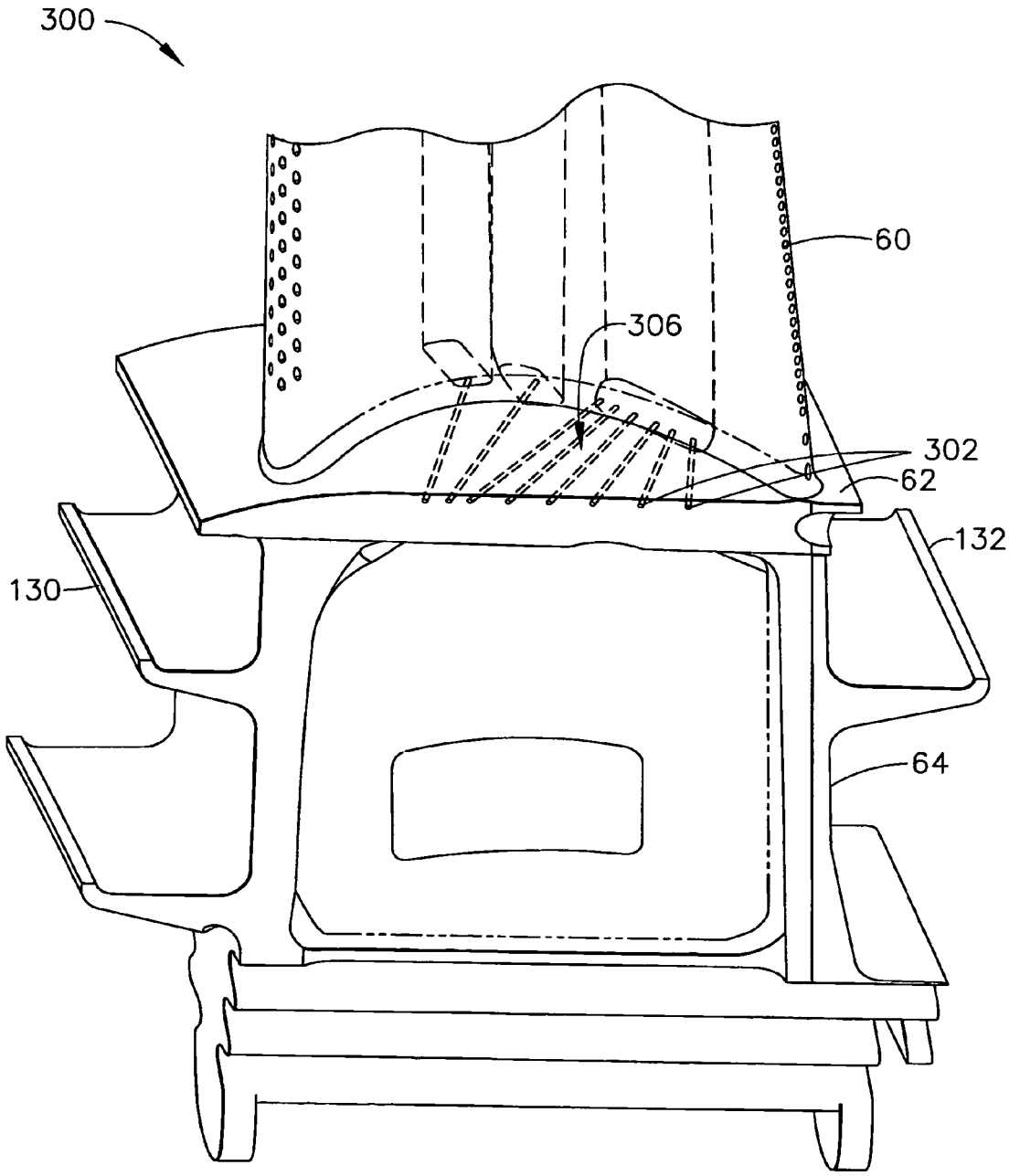
FIG. 6 is an alternative embodiment of a rotor blade that may be used with the gas turbine engine shown in FIG. 1.

FIG. 6 is an alternative embodiment of a rotor blade 300 that may be used with gas turbine engine 10 (shown in FIG. 1). Rotor blade 300 is substantially similar to rotor blade 40 (shown in FIGS. 2-5) and components in rotor blade 300 that are identical to components of rotor blade 40 are identified in FIG. 6 using the same reference numerals used in FIGS. 2-5. Accordingly, blade 300 includes airfoil 60, platform 62, shank 64, and dovetail 66.

Within rotor blade 300, platform 62 includes a plurality of convection cooling openings 302 which extend through at least a portion of platform 62. More specifically, each opening 302 couples internal cooling chamber 84 with platform 62. Openings 302 are oriented approximately parallel to platform radially outer surface 152 such that cooling air channeled from cooling chamber 84 is discharged through platform 62 to facilitate convective cooling of platform 62 within a central or middle region 306 of platform 62.

The above-described rotor blades provide a cost-effective and highly reliable method for supplying cooling air to facilitate reducing an operating temperature of the rotor blade platform. More specifically, through convective cooling flow, film cooling, and impingement cooling, thermal stresses induced within the platform, and the operating temperature of the platform is facilitated to be reduced. Accordingly, platform oxidation, platform cracking, and platform creep deflection is also facilitated to be reduced. As a result, the rotor blade cooling circuit facilitates extending a useful life of the rotor assembly and improving the operating efficiency of the gas turbine engine in a cost-effective and reliable manner.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade cooling circuit component can also be used in combination with other rotor blades, and is not limited to practice with only rotor blade 40 as described herein. Rather, the present invention can be implemented and utilized in connection with many other blade and cooling circuit configurations. For example, it should be recognized by one skilled in the art, that the platform impingement opening can be utilized with various combinations of platform cooling features including film cooling openings, platform scalloped portions, platform recessed trailing edge slots, shank recessed portions, and/or platform chamfered portions.

While the invention has been described in terms of various specific embodiments, those skilled in the art will recognize that the invention can be practiced with modification within the spirit and scope of the claims.

What is claimed is:

1. A method for assembling a rotor assembly for a gas turbine engine, said method comprising:

providing a first rotor blade that includes an airfoil, a platform, a shank, an internal cavity, and a dovetail, wherein the airfoil extends radially outward from the platform, the platform includes a radially outer surface and a radially inner, surface, the shank extends radially inward from the platform defined therein, and the dovetail extends from the shank, such that the internal cavity is defined at least partially by the airfoil, the platform, the shank, and the dovetail, and wherein one wall of the shank is convex;

coupling the first rotor blade to a rotor shaft using the dovetail such that during engine operation, cooling air is channeled from the blade internal cavity through a blade impingement cooling circuit for impingement cooling the first rotor blade platform radially inner surface;

positioning a seal pin within at least one of a leading edge seal pin cavity and a trailing edge seal pin cavity defined within the shank and adjacent to the convex wall of the shank; and coupling a second rotor blade to the rotor shaft such that a platform gap is defined between the first and second rotor blade platforms, and such that during operation a portion of a trailing edge of the first rotor blade platform is facilitated to be cooled by cooling air channeled through a recessed portion of the platform.

2. A method in accordance with claim 1 wherein each shank includes a pair of opposing sidewalls that extend generally axially between an upstream sidewall and a downstream sidewall, said coupling a second rotor blade to the rotor shaft further comprises coupling the second rotor blade to the shaft such that a shank cavity is defined between the first and second rotor blade shanks.

3. A method in accordance with claim 2 wherein coupling the first rotor blade to a rotor shaft further comprises coupling the first rotor blade to the shaft such that during operation cooling air is channeled from the shank cavity through a purge slot defined within a portion of the platform radially inner surface.

4. A method in accordance with claim 2 wherein coupling the first rotor blade to a rotor shaft further comprises coupling the first rotor blade to the shaft such that during operation the platform radially outer surface is film cooled by cooling air channeled through a plurality of film cooling openings that extend between the platform radially inner and outer surfaces.

5. A method in accordance with claim 2 wherein coupling the first rotor blade to a rotor shaft further comprises coupling the first rotor blade to the shaft such that during operation the platform radially outer surface is convectively cooled by cooling air channeled through a plurality of cooling openings that extend between the platform radially inner and outer surfaces.

6. A method in accordance with claim 2 wherein coupling the first rotor blade to a rotor shaft further comprises coupling the first rotor blade to the shaft such that during operation the shank cavity is facilitated to be pressurized by airflow entering the cavity through a recessed portion of the rotor blade shank upstream sidewall.

7. A method in accordance with claim 2 wherein coupling the first rotor blade to a rotor shaft further comprises coupling the first rotor blade to the shaft such that during operation the shank cavity is facilitated to be pressurized by airflow entering the cavity through a recessed portion defined radially inward from an angel wing extending outwardly from the rotor blade shank upstream sidewall.

8. A method in accordance with claim 2 wherein coupling the first rotor blade to a rotor shaft further comprises coupling the first rotor blade to the shaft such that during operation at least a portion of the platform is facilitated to be convectively cooled by cooling air channeled through a plurality of openings extending through the platform.

9. A method in accordance with claim 2 wherein positioning a seal pin further comprises positioning a seal pin in only the trailing edge seal pin cavity.

10. A rotor blade for a gas turbine engine, said rotor blade comprising:

a platform comprising a radially outer surface and a radially inner surface, said platform further comprises a leading edge sidewall and a trailing edge sidewall connected together by a convex-side wall and an opposite concave-side wall, a portion of said trailing edge sidewall is recessed between said platform radially outer and radially inner surfaces to facilitate platform trailing edge cooling:

an airfoil extending radially outward from said platform;

a shank extending radially inward from said platform, said shank comprising a leading edge seal pin cavity and a trailing edge seal pin cavity each defined therein adjacent to a convex wall of said shank, each of said leading edge and said trailing edge pin cavity facilitates sealing between adjacent pairs of said rotor blades, said shank further comprises a radial seal pin positioned within said trailing edge seal pin cavity, said shank leading edge seal pin cavity facilitates increasing platform film cooling;

a dovetail extending from said shank such that an internal cavity is defined at least partially by said airfoil, said platform, said shank, and said dovetail; and a cooling circuit extending through a portion of said shank for supplying cooling air from said cavity for impingement cooling of said platform radially inner surface.

11. A rotor blade in accordance with claim 10 wherein said platform further comprises a purge slot formed within a portion of said platform radially inner surface, said purge slot configured to channel cooling air therethrough for purging a gap defined between adjacent said rotor blade platforms.

12. A rotor blade in accordance with claim 10 wherein said platform further comprises a plurality of film cooling openings extending between said platform radially outer and radially inner surfaces for supplying cooling air for film cooling said platform radially outer surface.

13. A rotor blade in accordance with claim 12 wherein said shank extends axially between a forward sidewall and an aft sidewall, a portion of said forward sidewall is recessed to facilitate increasing pressure of cooling air supplied through said plurality of film cooling openings.

14. A rotor blade in accordance with claim 13 wherein said shank further comprises an angel wing extending outward from said shank forward sidewall, a portion of said shank forward sidewall radially inward from said angel wing is recessed.

15. A rotor blade in accordance with claim 10 wherein said platform further comprises a convex-side wall, a concave-side wall and a plurality of convection cooling openings, said convex-side and concave-side walls each extend between said platform radially outer and radially inner surfaces, said plurality of convection cooling openings extend between said cavity and said platform concave-side wall for supplying cooling air for convective cooling of said platform concave-side wall.

16. A rotor blade in accordance with claim 10 wherein a portion of said platform is chamfered to facilitate reducing a heat transfer coefficient of at least a portion of said platform.

17. A rotor blade in accordance with claim 10 wherein said leading edge seal pin cavity and said trailing edge seal pin cavity is defined by a pair of substantially parallel axially-disposed sidewalls that are connected by a radially outer sidewall that extends obliquely between said axially-disposed sidewalls.

18. A rotor blade in accordance with claim 17 wherein said pin cavity radially outer sidewall facilitates enhancing radial pin sealing between adjacent said rotor blades.

19. A gas turbine engine rotor assembly comprising:

a rotor shaft; and a plurality of circumferentially-spaced rotor blades coupled to said rotor shaft, each said rotor blade comprising an airfoil, a platform, a shank extending radially inward from said platform, and a dovetail, said airfoil extending radially outward from said platform, said platform comprising a radially outer surface and a radially inner surface, said platform further comprising a leading edge sidewall and an opposite trailing edge sidewall connected together by a pair of oppositely disposed platform sidewalls, a portion of said trailing edge sidewall is recessed between said platform radially outer and inner surfaces to facilitate cooling of said platform trailing edge, said shank comprising a leading edge seal pin cavity and a trailing edge seal pin cavity defined therein, each said pin cavity facilitates sealing between adjacent pairs of said rotor blades, said shank further comprises a radial seal pin positioned within said trailing edge seal pin cavity, said shank leading edge seal pin cavity is sized to receive a radial seal pin therein and to channel airflow therethrough to facilitate increasing platform film cooling, said dovetail extending from said shank for coupling said rotor blade to said rotor shaft such that an internal blade cavity is defined at least partially by said airfoil, said platform, said shank, and said dovetail, at least a first of said rotor blades comprising an impingement cooling circuit extending through a portion of said shank for channeling cooling air from said blade cavity for impingement cooling said platform radially inner surface.

20. A gas turbine engine rotor assembly in accordance with claim 19 wherein each said shank comprises a pair of opposing sidewalls that extend axially between an upstream sidewall and a downstream sidewall, said plurality of rotor blades circumferentially-spaced such that a shank cavity is defined between each pair of adjacent said rotor blades, each said shank cavity radially inward from each said platform.

21. A gas turbine engine rotor assembly in accordance with claim 20 wherein said first rotor blade further comprises a purge slot defined within said platform radially inner surface, said purge slot for channeling cooling air through a gap defined between adjacent said rotor blade platforms.

22. A gas turbine engine rotor assembly in accordance with claim 20 wherein said first rotor blade platform further comprises a plurality of film cooling openings extending between said platform radially outer and inner surfaces for channeling cooling air from said shank cavity for film cooling said platform radially outer surface.

23. A gas turbine engine rotor assembly in accordance with claim 20 wherein a portion of said first rotor blade shank upstream sidewall is recessed to facilitate pressurizing said shank cavity.

24. A gas turbine engine rotor assembly in accordance with claim 20 wherein each said rotor blade shank further comprises an angel wing extending radially outward from said shank upstream sidewall, a portion of said shank upstream sidewall radially inward from said first rotor blade angel wing is recessed to facilitate pressurizing said shank cavity.

25. A gas turbine engine rotor assembly in accordance with claim 20 wherein each said rotor blade platform further comprises a convex-side sidewall, a concave-side sidewall, and a plurality of cooling openings, said convex-side and said concave-side sidewalls each extend between said platform radially inner and outer surfaces, said plurality of cooling openings for channeling cooling air therethrough for convective cooling of said platform.

26. A gas turbine engine rotor assembly in accordance with claim 20 wherein a portion of said first rotor blade platform is chamfered to facilitate reducing a heat transfer coefficient of said platform.

27. A gas turbine engine rotor assembly in accordance with claim 20 wherein said first rotor blade leading edge seal pin cavity and said trailing edge seal pin cavity is defined by a pair of substantially parallel axially-disposed sidewalls that are connected together by a radially outer sidewall that extends obliquely between said axially-disposed sidewalls.

28. A gas turbine engine rotor assembly in accordance with claim 27 wherein said first rotor blade pin cavity radially outer oblique sidewall facilitates enhancing radial pin sealing between adjacent said rotor blades.

* * * * *